United States Patent [19]

Fitch et al.

[11] 4,331,084

[45] May 25, 1982

[54] FUEL FEED TECHNIQUE FOR AUGER COMBUSTOR

[75] Inventors: Robert E. Fitch, Kent, Wash.; Robert C. Tyer, Baldwin, Fla.

[73] Assignee: The Boeing Company, Seattle, Wash.

[21] Appl. No.: 148,370

[22] Filed: May 9, 1980

[51] Int. Cl.[3] ..... F23N 5/18

[52] U.S. Cl. ..... 110/186; 110/187; 110/101 CC; 110/101 CF

[58] Field of Search ..... 110/203–205, 110/210–212, 186, 187, 185, 267, 101 CC, 101 CF

[56] References Cited

U.S. PATENT DOCUMENTS

| | | | |
|---|---|---|---|
| 1,398,790 | 11/1921 | Ogur | 110/101 CC |
| 1,826,106 | 10/1931 | Vodoz | 110/101 CC |
| 1,958,095 | 5/1934 | Papez | 110/101 CF |
| 2,299,727 | 10/1942 | Blauvelt et al. | 110/101 CC |
| 3,780,676 | 12/1973 | Hazzard et al. | 110/187 |
| 4,009,667 | 3/1977 | Tyer et al. | 110/186 |
| 4,060,042 | 11/1977 | Baraldi et al. | 110/186 |

*Primary Examiner*—Henry C. Yuen

*Attorney, Agent, or Firm*—Finnegan, Henderson, Farabow, Garrett & Dunner

[57] ABSTRACT

A feeding system for a starved-air combustor which enables the batch feeding of preselected weights of fuel into a combustion chamber of the starved-air combustor. The feeding system also blocks the entry of ambient air into the combustion chamber during the feeding of fuel to the chamber and can control the feeding of fuel into the combustion chamber in response to the orientation of a fuel-conveying auger in the combustion chamber.

9 Claims, 3 Drawing Figures

SPLITTER VALVE CONTROL
COVER VALVE CONTROL
FEED CONTROL CIRCUIT
RELEASE VALVE CONTROL
AUGER POSITION SENSOR
R
ERROR
RESTORE
105
107
201
203
205
207
209
211
213
215
217
218
219
221
223
225
227
229
231
233
235
111
113
115
121
151
153

BIN FULL
COVER VALVE
SPLITTER VALVE
AUGER POSITION
RELEASE VALVE
TIME

FUEL FEED TECHNIQUE FOR AUGER COMBUSTOR

BACKGROUND OF THE INVENTION

In the last century, much of the world's energy needs have been fulfilled by hydrocarbon fuels which provided a convenient, plentiful, and inexpensive energy source. The current rising costs of such fuels and concerns over the adequacy of their supply in the future has made them a less desirable energy source and has led to an intense investigation of alternative sources of energy. The ideal alternative energy source is a fuel which is renewable, inexpensive, and plentiful, with examples of such fuels being the byproducts of wood, pulp, and paper mills, and household and commercial refuse.

The use of alternative energy sources is not problem-free, however, since there is a concern over the contents of the emissions from the combustion of such fuels as well as the environmental ramifications of acquiring and transporting the fuel and disposing of the residue of combustion.

One promising prior art device for using such alternative energy sources, while maintaining a high degree of enviromental quality, is the starved-air combustor wherein the air supplied for combustion is controlled in order to control temperature conditions and the rates of combustion are controlled to consume the fuel entirely. Such starved-air combustors are capable of burning various types of fuel and producing significant amounts of heat which can be employed for any number of purposes including the production of process steam for use in manufacturing and in the generation of electricity.

Starved-air combustors as previously known and operated, have not been entirely satisfactory in both entirely consuming the combustible elements of the fuel at high throughput while not producing noxious emissions. This problem results, in part, from the use of such starved-air combustors to burn a wide variety of fuels some of which may be non-homogeneous, e.g., household or commercial refuse. It has not been possible in the previously known starved-air combustors to tailor in a real time manner the combustion processes to the type of fuel being combusted in order to maximize the efficiency of the combustor while minimizing the generation of air pollutants. While the pollution problem can be solved to a degree by the utilization of scrubbers and other antipollution devices, such mechanisms are very expensive and their cost may militate against the use of alternative energy sources.

SUMMARY OF THE INVENTION

It is an object of the present invention to provide a starved-air combustor capable of efficiently utilizing many different types and quantities of fuel.

Another object of this invention is to provide a starved-air combustor which does not release noxious pollutants into the atmosphere.

Yet another object of this invention is to provide a starved-air combustor which is capable of combusting to a very high degree the percentage of all combustible materials provided to it as fuel.

Still another object of this invention is to provide a starved-air combustor including means for selectively feeding predetermined weights of fuel into the combustion chamber of the starved-air combustor.

To achieve these objects, and in accordance with the purpose of the invention, as embodied and broadly described herein, the starved-air combustor comprises combustion chamber means having an inlet end for receiving fuel, the combustion chamber means for combusting the received fuel to produce combustion gases and combustion residue, the combustion chamber means including an outlet end for discharging the combustion residue and an outlet port for discharging the combustion gases, means in the combustion chamber means for conveying the received fuel from the inlet end toward the outlet end, and means for selectively feeding predetermined weights of the fuel into the inlet end of the combustion chamber.

The accompanying drawings, which are incorporated in and constitute a part of this specification, illustrate an embodiment of the invention and, together with the description, serve to explain the principles of the invention.

DESCRIPTION OF THE PREFERRED EMBODIMENT

Figure 1:
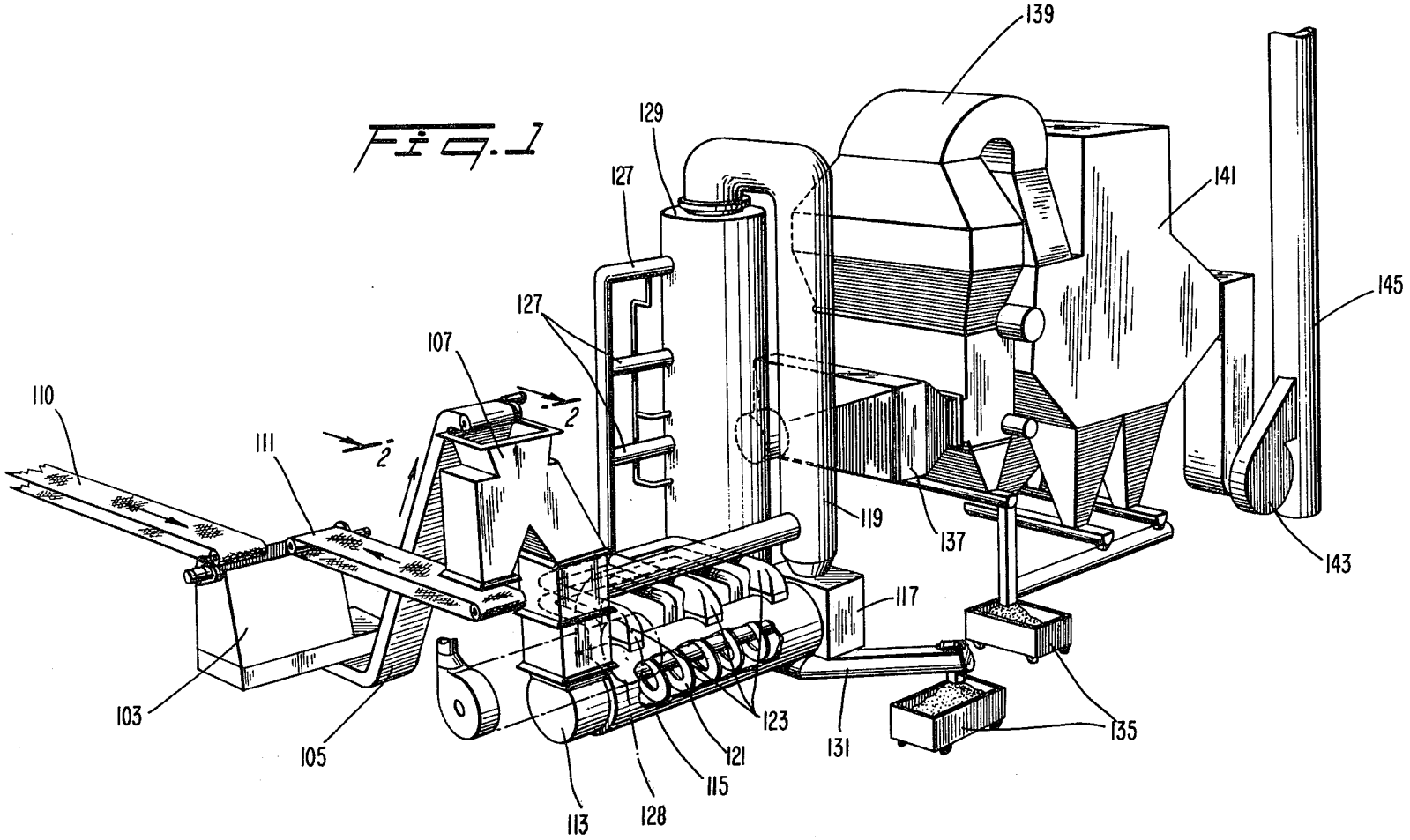
FIG. 1 is an illustration of the starved-air combustor of the instant invention combined between a fuel supply system and a system which produces process steam from the heat produced by the starved-air combustor.

FIG. 1 illustrates an embodiment of a starved-air combustor according to the present invention coupled between a refuse feeder system and a steam generation system. As embodied herein, the refuse supply comprises a supply conveyor 101 for conveying fuel, in this instance refuse, from a receiving building (not shown) and one or more storage silos (not shown). The receiving building and storage silos are to insure that an adequate supply of fuel can be supplied to the combustor in order to permit the combustor to run at peak efficiency. In the illustrated embodiment, it is contemplated that the supply conveyor 101 would supply fuel to the fuel surge and recirculation bin 103 at a rate of at least fifteen tons per hour and that the capacity of the combustor system would range from 150 to 500 pounds of fuel per minute.

The fuel surge and recirculation bin 103 comprises an additional means for insuring that a constant and adequate supply of fuel is available to the combustor. The bin 103 could, for example, contain at least 10 minutes capacity of fuel, i.e., approximately 2.5 tons, which is received at the top of the bin 103 and supplied through the bottom of the bin 103 to the feed conveyor 105. Feed conveyor 105 supplies the fuel to a splitter 107 which may either direct the fuel into the feed and weigh bin 109 or, when the feed and weigh bin 109 is filled to capacity, to the return conveyor 111 for return to the fuel surge and recirculation bin 103. The feed and weigh bin 109 is calibrated to supply a constant weight of fuel at the inlet end 113 of the combustor 115 at such time that the first flight of an auger 121 within the chamber 115 has been rotated into a fuel receiving position. Within the starved-air combustor 115 there is provided a well-known oil igniter (not shown) in the input end of the combustion chamber to serve as a means for initially igniting the fuel upon start-up of the starved air combustor.

U.S. Pat. No. 4,009,667 issued to Robert C. Tyer et al on Mar. 1, 1977, illustrates an appropriate embodiment for a rotatably-driven auger comprised of a rotatable, water-cooled horizontal shaft supporting a spiral flight of decreasing pitch from the input end of the auger to the output end. It is contemplated in the instant system that the speed of the auger would range from 0.3 to 1 rpm. An appropriate oil igniter would comprise an oil burner having its flame extending into the input end of the combustor 115 to heat and to ignite the initial load of fuel supplied by the feed and weigh bin 109. It is contemplated that such an oil ignitor would be capable of burning fuel at a rate of approximately six gallons per hour at two pounds per square inch pressure.

The combustor 115 has an output end 117 connected to a duct 119 which feeds the top of an afterburner 129. The combustor 115 also includes air supply means 123 for supplying underfire air and conduits 125 for supplying overfire air. This air is provided by a fan 126 (shown in phantom) which also supplies air through conduits 127 to the afterburner 129. Alternatively, a separate fan or fans may be provided to supply underfire air, overfire air, and air to the afterburner. A small air distributor 130 is connected to the upper conduit 127 to supply air into afterburner 129 through special injectors located both at and below the midpoint of the afterburner 129.

Afterburner 129 is provided, in part, as a secondary combustor chamber which mixes the air supplied by the conduits 127 with the gaseous and entrained solid particle output of the combustor from the outlet end 117 to combust all combustible material in the gaseous output and, in part, to separate suspended ash and non-combustible solids from the hot non-combustible gas. Both the non-combustible material from the afterburner 129 and the combustor residue from combustor 115 are fed through conduit 131 to an ash collector 135. The hot non-combustible gas exits into a superheater 137 from which it is supplied to a waste heat boiler 139 to produce, in this case, process steam. An electrostatic precipitator 141 removes any additional solids from the now cooler non-combustible gas exiting from the waste heat boiler 139 through the economizer 140 and the solid material is conveyed to an ash cart 135. From the precipitator 141, the non-combustible gas is drawn by a fan 143 and expelled from stack 145. Upon entering into the fan the temperature of the gas is approximately 300 to 400 degrees Fahrenheit and the fan 143 is of sufficient strength to exert a negative pressure in the system from the combustor 115, the afterburner 129, superheater 137, waste heat boiler 139, economizer 140, and precipitator 141.

The present invention is particularly concerned with an apparatus for selectively feeding predetermined weights of fuel into the inlet end of the combustion chamber of the starved-air combustor. By feeding only preselected weights of fuel, the present invention avoids a serious problem in the prior art starved-air combustors which greatly reduced the efficiency of such combustors. This inefficiency resulted from a varying fuel-to-air ratio in the combustion chamber 115. As discussed in the previously preferred patent to Tyer et al, the combustion chamber 115 is provided with underfire air which is air introduced through the walls of the combustion chamber 115 underneath the fuel in the chamber. Similarly, overfire air is injected through the walls of the combustion chamber above the fuel to aid combustion. Assuming that a constant volume of air is injected into the combustion chamber as underfire and overfire air, then the air-to-fuel ratio will be determined by the amount of fuel fed into the combustor. The prior art starved-air combustors did not regulate the amount of fuel fed thereto and could not establish proper air-to-fuel ratio. Also, it is advantageous to set different air-to-fuel ratios for different types of fuel consumed in the combustor in order to maximize the efficiency of combustion and to minimize the pollutants in the exhaust gas, but if the quantity of fuel fed into the combustion chamber cannot be regulated, then no definite air-to-fuel ratio can be maintained.

The instant invention enables the air-to-fuel ratio to be selected by feeding predetermined weights of fuel into the inlet end of the combustion chamber in a batch mode. The weight of a particular fuel charge or batch could, for example, be selected to range from 150 to 500 pounds depending upon the combustability of the fuel currently being feed to the combustor. Thus, if a particular air-to-fuel ratio is desired then it can be accomplished merely by selecting a particular weight for each charge or batch of fuel and specific airflow for that feed rate.

Feeding fuel in a charge or a batch mode into the inlet of the combustion chamber provides a further advantage over the prior art starved-air combustors by enabling the combustor to achieve a maximum throughput. If, for example, unregulated amounts of fuel are supplied to the combustor as exhibited in U.S. Pat. No. 3,942,455 issued to Wallis on Mar. 9, 1976, then there exists the probability that the auger within the combustion chamber will be conveying either too little or too much fuel through the combustion chamber at any one time. Feeding the fuel in predetermined batch weights, as is done by the present invention, permits control over the combustion processes and a level of efficiency in the manner not previously attainable.

Figure 2:
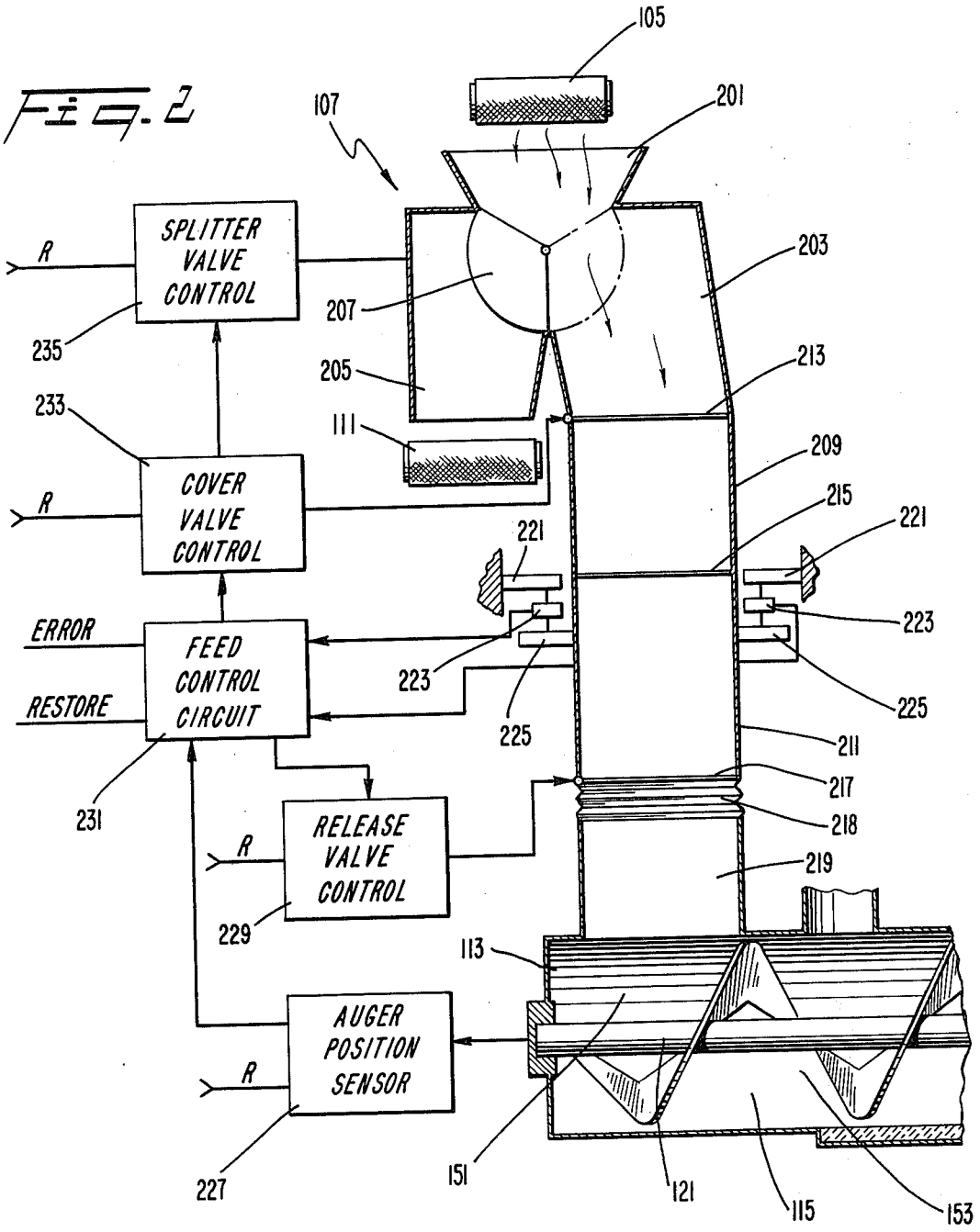
FIG. 2 is an enlarged cross-sectional view taken along lines 2—2 of FIG. 1 illustrating the fuel supply apparatus of the instant invention.

Referring to FIG. 2, the starved-air combustor comprises a combustion chamber 115 including an inlet end 113. As embodied herein, the combustion chamber comprises a refractory-lined horizontal cylinder chamber extending from the inlet end 113 to the outlet end 117. Within the chamber, there resides means for conveying fuel from the inlet end to the outlet end. As herein embodied, the conveying means comprises the screw conveyor or auger 121 formed with a rotatable cylindrical axis within the cylindrical combustion chamber with a spiral flight concentrically connected to the axis. As is well-known in the art, the spiral flight in cooperation with the axis forms an auger and provides a plurality of spaces 151 and 153 defined by the walls of the combustion chamber 115 and the spiral flight of the auger 121. As seen in FIG. 2, the orientation of the auger 121 within the combustion chamber 115 beneath the inlet end 113 illustrates the correct time for feeding fuel into the combustion chamber. This orientation causes area 151 to have its largest volume but, if desired, different orientations of the auger to present an area 151 of different volume could also be designated the feed position or positions.

The instant invention also includes means for selectively feeding predetermined weights of the fuel into the inlet end 113 of the combustion chamber 115. As embodied herein, the feeding means comprises means for receiving and containing the fuel, means for weighing the received and contained fuel, and means for selectively discharging the received and contained fuel responsive to the positioning of the auger 121 into the feeding orientation and to the accumulation of a preselected weight of fuel in the receiving and containing means.

A suitable embodiment for the receiving and containing means comprises a chute 201 positioned beneath the fuel feed conveyor 105 such that the fuel conveyed by the conveyor 105 drops off to the conveyor 105 into the chute 201. From the chute 201, the fuel can either pass into the combustor feed path 203 of the feeding and receiving means or through path 205 to the return conveyor 111 for return to the surge bin 103 as previously explained. A splitter 207 is rotatable in the neck of the chute 201 to guide the received fuel to the combustor feed path 203 or to the return path 205.

The receiving and containing means further includes a chute 209 for guiding the fuel directed to the combustor 115 into a weigh bin 211. A cover valve 213 is provided at the inlet of the chute 209 and is rotatable either to permit the fuel to pass into the chute 209 and the weigh bin 211 when the cover valve is in an open, or downward, position or to prevent additional fuel from entering chute 209 and weigh bin 211 when the cover valve 213 is in a closed, i.e., as illustrated in FIG. 2, a horizontal position. The cover valve 213 provides an airtight seal with the sides of the chute 209 such that when the cover valve 213 is closed, outside air is prevented from entering chute 209 and weigh bin 211. The cover valve 213 could alternatively be a slidable valve having an inward (closed) position and an outward (open) position.

The weigh bin 211 is connected to chute 209 via a flexible coupling 215 so that the weight of the weigh bin 211 and any fuel contained therein is not supported by the chute 209 but, as will be hereinafter explained, is supported by means of one or more weigh cells 223 connected to a stationary support member 221 and to support arms 225 on the exterior of the weigh bin 211.

As embodied herein, the discharging means comprises a release valve 217 shown in FIG. 2 in its closed position. As will also hereinafter be explained, the release valve 217 will not be opened, i.e., rotated to extend into the lower chute portion 219 of the feeding means, until the weighing means indicates that a predetermined weight of fuel has been accumulated in the weigh bin 211 and that an auger position sensor 227 has determined that the auger 122 has been rotated into the proper feed orientation. The lower chute portion 219 is coupled to the weigh bin 211 by means of a flexible, airtight seal 218 so as not to support the weigh bin 211 but only to guide the fuel into the inlet end 113 of the combustion chamber 115 while simultaneously preventing ambient air from entering the combustion chamber.

The weighing means, as embodied herein, comprises one or more weigh cells 223 coupled, as above-described, between stationary support members 221 and exterior arms 225 connected to the weigh bin 211. One skilled in the art will readily recognize that each weight cell 223 comprises any one of a number of means whereby a particular weight can be selected, the weight of the weigh bin including fuel received and contained therein determined, and an output signal generated when the measured weight of the weigh bin exceeds a selected weight. As one example, the weigh cell 223 could comprise a variable resistor providing a voltage output indicative of the weight of fuel in weigh bin 211. A voltage detector senses the voltage output of the variable resistor and actuates a microswitch when the sensed voltage exceeds a threshold voltage corresponding to a selected weight. The output of the microswitch is then employed within suitable logic circuitry, as will be hereinafter explained, to actuate the splitter 207, cover valve 213, and release valve 217 to feed the conveyor with fuel in a proper manner.

Figure 3:
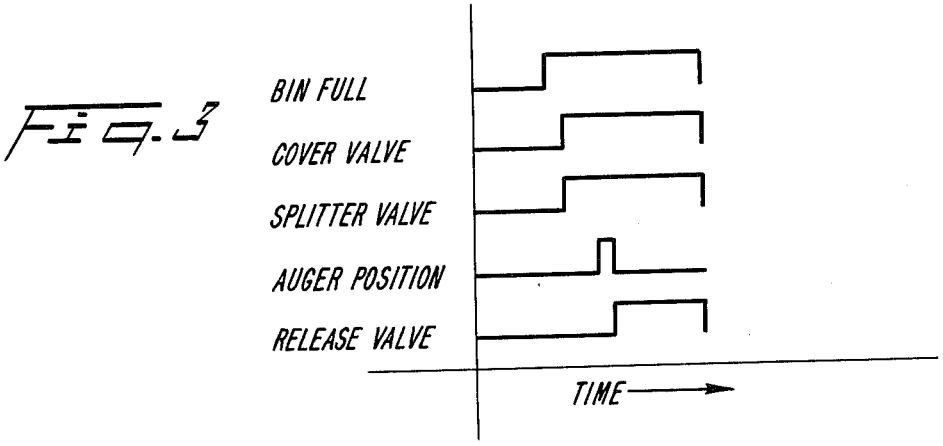
FIG. 3 is a timing diagram illustrating the sequence of operation of the fuel-feeding apparatus of FIG. 2.

FIG. 2 also illustrates, in block diagram form, functional logic circuits that are needed to control the feeding means to feed fuel either into the combustor 115 or to the return conveyor 111. FIG. 3 is a timing diagram to be read in conjunction with the block diagram of FIG. 2 for a complete understanding of the operation of the logic circuits.

In normal operation, during the combustor feed mode, the splitter valve 207 will be positioned as indicated by the solid lines in FIG. 2. The cover valve 213 will be in its opened, or downward position, and the release valve 217 will be in the closed position as shown in FIG. 2. Fuel will drop from feed conveyor 105 through feed path 203 and upper chute 209 into the weigh bin 211. This will gradually increase the weight of fuel in the weigh bin 211 and when the preselected weight of a batch or charge of fuel has been accumulated in the weigh bin 211 then the weigh cells 223 will cause a bin full signal to be supplied from the weigh cells 223 to feed control circuit 231 to change from a low value to a high value as shown in FIG. 3.

After the preselected weight has been accumulated in the weigh bin 211, it is necessary to rotate the splitter valve 207 into the orientation shown by the dotted lines in FIG. 2 and to close the cover valve 213. This is performed under the control of feed control circuit 231 by supplying the appropriate output to cover valve control 233 and to splitter valve control 235. Once the cover valve 213 has been rotated into its closed and air-sealing position, then the feeding means will not change state until the auger position sensor 227 determines that the auger 121 has been rotated into an orientation such that the first area 151 is of its proper volume. When this orientation of the auger 121 is reached, the auger position sensor 227 supplies a pulse, as shown in FIG. 3, to the feed control circuit 231.

There are many ways of implementing the auger position sensor 227 but one would be to attach a small magnetic flux producing element to the auger such that it would be presented in alignment with a flux sensor when the auger has been rotated into the feed orientation.

After the feed control circuit has received the auger position pulse and is still receiving the bin full signal at a high level, it will signal the release valve control 229 to rotate the release valve 217 to its downward orientation in order to permit the fuel contained within the weigh bin 211 to pass through lower chute 219 and into the first area 151 of the combustion chamber 115. The feed control circuit 231 will produce, after a suitable delay to provide time for the fuel to be discharged from the weigh bin 211, a restore pulse that is supplied to the auger position sensor 227, release valve control 229, cover valve control 233, and splitter valve control 235 to control the feeding means in a manner to permit the accumulation of a subsequent charge or batch of fuel in the weigh bin 211. As explained above, this feeding orientation comprises: first, closing release valve 217; second, opening the cover valve 213; and third, rotating splitter valve 207 into the orientation illustrated by the solid lines in FIG. 2. The weigh cells 223 will automatically reset the microswitch because, after the discharge of the fuel from weigh bin 211, the weigh cells 223 will no longer indicate that the preselected fuel weight has been accumulated in weigh bin 211.

Since one of the purposes of this instant invention is to provide only preselected weights of fuel to the combustor 115, the feed control circuit 231 will generate an error signal if auger position sensor 227 determines that the auger 121 is in the feed orientation and provides a pulse to feed control circuit 231, while at the same time the weigh cells 223 have not supplied signals to feed control circuit 231 indicating that the predetermined weight of fuel had been accumulated in weigh bin 211. If such a situation occurs, the starved-air combustor could either be shut down temporarily, the feed conveyor means 105 accelerated to supply greater volumes of fuel per unit time, or an appropriate alarm actuated to indicate that the starved-air combustor is operating at less than optimum capacity because insufficient fuel is being provided or, alternatively, any combination of these actions could be taken.

It will be further apparent to those skilled in the art, that various modifications and variations can be made to the feeding means of the starved-air combustor without departing from the scope or spirit of the invention and it is intended that the present invention cover the modifications and variations of the system provided that they come within the scope of the appended claims and their equivalents.

What is claimed is:

1. A starved-air combustor comprising:

a combustion chamber having an inlet end for receiving fuel, said combustion chamber for combusting said fuel to produce hot combustion gases and combustion residue, said combustion chamber also having an outlet end for discharging said combustion residue, and an outlet port for discharging said hot combustion gases;

means in said combustion chamber for conveying said received fuel from said inlet end toward said outlet end, said conveying means comprising a rotatable screw conveyor extending along the length of said chamber, said screw conveyor including a spiral flight defining a plurality of spaces within said combustion chamber, a first of said spaces located adjacent said inlet end of said combustion chamber; and means for selectively and intermittently feeding predetermined weights of said fuel in a batch mode into said inlet end of said combustion chamber, said feeding means including means for receiving and containing said fuel, means for weighing said received and contained fuel, and means for selectively discharging said received and contained fuel responsive to the positioning of said screw conveyor into a predetermined orientation and to the accumulation of a preselected weight of said fuel in said receiving and containing means, said discharging means including a release valve connected to one end of said fuel receiving and containing means to enable in a first valve position the discharging of said fuel from said fuel receptacle into said inlet end of said combustion chamber and to enable in a second valve position the accumulation of said fuel in said fuel receptacle; and a cover valve connected to the other end of said fuel receiving and containing means to enable in a first valve position the hermetic sealing of said receiving and containing means from ambient air and to prevent the accumulation of fuel in said receiving and containing means, and to enable in a second valve position said fuel to pass into said receiving and containing means.

2. A starved-air combustor according to claim 1 wherein said conveying means further includes a cylindrical axle extending along the length of said combustion chamber, said spiral flight being concentrically connected to said axle.

3. A starved-air combustor comprising:

a cylindrical combustion chamber having an inlet end for receiving fuel and an outlet end for discharging combustion gases and combustion residue, said combustion chamber for combusting said received fuel to produce said combustion gases and combustion residue;

a rotatable screw conveyor in said combustion chamber for conveying said fuel from said inlet end toward said outlet end, said screw conveyor comprising a cylindrical axle extending along the length of said chamber and a spiral flight concentrically connected to said axle, said spiral flight and said cylindrical axle defining in said combustion chamber a plurality of spaces around said cylindrical axle, a first of said spaces being located beneath said inlet end of said cylindrical combustion chamber;

means for sensing the orientation of said screw conveyor in said cylindrical combustion chamber; and means for selectively and intermittently feeding predetermined weights of said fuel in a batch mode into said first space through said inlet end, said feeding means including a fuel receptacle for receiving and for containing said fuel, means for weighing said received and contained fuel, and means responsive to the sensing of a predetermined orientation of said screw conveyor in said cylindrical combustion chamber by said sensing means and to the accumulation of a selected weight of said fuel in said fuel receptacle for discharging said fuel in said fuel receptacle into said first space, said discharging means including a release valve connected to one end of said fuel receptacle to enable in a first valve position the discharging of said fuel from said fuel receptacle into said inlet end of said combustion chamber and to enable in a second valve position the accumulation of said fuel in said fuel receptacle; and a cover valve connected to the other end of said fuel receptacle to enable in a first valve position the hermetic sealing of said fuel receptacle from ambient air and to prevent the accumulation of fuel in said fuel receptacle, and to enable in a second valve position said fuel to pass into said fuel receptacle.

4. A starved-air combustor according to claim 1, 2, or 3 wherein a plurality of said predetermined orientations are included in a single complete revolution of said screw conveyor.

5. A starved-air combustor according to claim 1 or 3 further including:

a storage bin for storing said fuel;

a first fuel feed conveyor for supplying fuel from said storage bin;

a second fuel feed conveyor for supplying fuel to said storage bin; and a fuel path controller for receiving said fuel supplied by said first fuel feed conveyor and in a first mode for supplying the received fuel to said fuel receptacle and in a second mode responsive to a predetermined amount of fuel being accumulated in said fuel receptacle for supplying said fuel received from said first fuel feed conveyor to said second fuel feed conveyor.

6. A starved-air combustor according to claim 5 wherein said fuel path controller comprises a rotatable fuel feed valve having a first position associated with said first mode and a second position associated with said second mode.

7. A starved-air combustor comprising:

a combustion chamber having an inlet end for receiving fuel, said combustion chamber for combusting said fuel to produce hot combustion gases and combustion residue, said combustion chamber also having an outlet end for discharging said combustion residue, and an outlet port for discharging said hot combustion gases;

means in said combustion chamber for conveying said received fuel from said inlet end toward said outlet end; and means for selectively feeding predetermined weights of said fuel into said inlet end of said combustion chamber, said feeding means comprising:

a fuel receptacle for receiving said fuel;

means for weighing the amount of fuel accumulated in said fuel receptacle; and means for discharging all of said fuel in said fuel receptacle in a single batch into said inlet end of said combustion chamber responsive to said weighing means determining that a preselected weight of said fuel has been accumulated in said fuel receptacle, said discharging means including a cover valve connected to one end of said fuel receptacle to enable in a first valve position the hermetic sealing of said fuel receptacle from ambient air and to prevent the accumulation of fuel in said fuel receptacle and to enable in a second valve position said fuel to pass into said fuel receptacle, and a release valve connected to the other end of said fuel receptacle to enable in a first valve position the discharging of said fuel from said fuel receptacle into said inlet end of said combustion chamber and to enable in a second valve position the accumulation of said fuel in said fuel receptacle.

8. A starved-air combustor according to claim 7 further including a stationary support, wherein said weighing means comprises at least one weigh cell and wherein said fuel receptacle is connected to said support by said weigh cell such that said weigh cell determines and indicates the weight of said fuel accumulated in said fuel receptacle.

9. A starved-air combustor according to claim 7 further including a release valve connected to the other end of said fuel receptacle to enable in a first valve position the discharging of said fuel from said fuel receptacle into said inlet end of said combustion chamber and to enable in a second valve position the accumulation of said fuel in said fuel receptacle.

* * * * *